US008721284B2

(12) United States Patent
Balliel et al.

(10) Patent No.: US 8,721,284 B2
(45) Date of Patent: May 13, 2014

(54) HOLLOW-CAST CASTING WITH A CLOSURE DEVICE

(75) Inventors: Martin Balliel, Basserdorf (CH); Christoph Didion, Wettingen (CH); Thomas Duda, Wettingen (CH); Marcel Koenig, Wettingen (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 12/878,691

(22) Filed: Sep. 9, 2010

(65) Prior Publication Data

US 2011/0056648 A1 Mar. 10, 2011

Related U.S. Application Data

(63) Continuation of application No. PCT/EP2009/052524, filed on Mar. 4, 2009.

(30) Foreign Application Priority Data

Mar. 11, 2008 (CH) ..... 365/08

(51) Int. Cl.
*F01D 5/18* (2006.01)
*F01D 9/06* (2006.01)

(52) U.S. Cl.
USPC ..... 416/96 R; 416/61; 416/224; 415/115; 415/118; 164/92.1; 411/349; 411/549; 411/553; 24/580.1; 24/DIG. 53; 24/DIG. 56; 24/DIG. 60; 220/297; 220/298; 220/301

(58) Field of Classification Search
USPC ..... 415/115, 118; 416/61, 90 R, 92, 96 R, 416/96 A, 97 R, 224; 164/92.1; 411/349, 411/549, 553; 24/580.1, DIG. 53, DIG. 56, 24/DIG. 60; 220/293, 297, 298, 301; 215/332; 217/107
See application file for complete search history.

(56) References Cited

U.S. PATENT DOCUMENTS

| | | | | | |
|---|---|---|---|---|---|
| 1,651,503 | A | * | 12/1927 | Belluzzo | 416/96 R |
| 2,476,339 | A | * | 7/1949 | Von Opel | 411/349 |
| 2,543,430 | A | * | 2/1951 | Anderson | 220/234 |
| 2,626,773 | A | * | 1/1953 | Backman | 411/349 |
| 2,821,323 | A | | 1/1958 | Lee, II | |
| 3,331,638 | A | * | 7/1967 | Fruth | 220/293 |
| 4,020,970 | A | * | 5/1977 | Koscik et al. | 220/293 |
| 4,486,918 | A | * | 12/1984 | Peebles | 24/DIG. 53 |
| 4,762,437 | A | * | 8/1988 | Mitomi | 411/349 |

(Continued)

FOREIGN PATENT DOCUMENTS

| | | | |
|---|---|---|---|
| BE | 448126 | A | 11/1942 |
| DE | 3936171 | A1 | 5/1991 |

(Continued)

*Primary Examiner* — Christopher Verdier
(74) *Attorney, Agent, or Firm* — Buchanan Ingersoll & Rooney PC

(57) ABSTRACT

A hollow-cast casting is provided, which includes at least one core opening that is caused by the production technique and which has a closure device that closes the core opening. The closure device can be inserted into the core opening axially in relation to the core opening and provides at least one surface region which, in axial projection in relation to the core opening, can be made to abut a surface region of the casting that is facing toward the casting. The surface region lies radially outside a cross-sectional area predetermined by the core opening.

9 Claims, 4 Drawing Sheets

(56) References Cited

U.S. PATENT DOCUMENTS

| | | | | |
|---|---|---|---|---|
| 5,094,580 | A * | 3/1992 | Abe | 411/553 |
| 5,183,385 | A * | 2/1993 | Lee et al. | 416/97 R |
| 6,007,296 | A * | 12/1999 | Ernst et al. | 415/115 |
| 6,193,468 | B1 | 2/2001 | Beeck et al. | |
| 6,378,931 | B1 * | 4/2002 | Kolluri et al. | 296/146.15 |
| 6,413,041 | B1 | 7/2002 | Sedillo | |
| 6,454,156 | B1 * | 9/2002 | Taras et al. | 228/165 |
| 6,837,417 | B2 * | 1/2005 | Srinivasan | 228/119 |
| 7,077,622 | B2 * | 7/2006 | Ehrhard et al. | 415/9 |

FOREIGN PATENT DOCUMENTS

| | | | |
|---|---|---|---|
| DE | 4434139 | C1 | 8/1995 |
| DE | 19905887 | C1 | 8/2000 |
| DE | 102006053179 | A1 | 5/2007 |
| EP | 0119289 | A1 | 9/1984 |
| EP | 0928655 | A1 | 7/1999 |
| EP | 1027943 | A1 | 8/2000 |
| JP | 11229955 | A | 8/1998 |

* cited by examiner

HOLLOW-CAST CASTING WITH A CLOSURE DEVICE

CROSS REFERENCE TO RELATED APPLICATION

This application is a continuation of International Application No. PCT/EP2009/052524 filed Mar. 4, 2009, which claims priority to Swiss Patent Application No. 00365/08, filed Mar. 11, 2008, the entire contents of all of which are incorporated by reference as if fully set forth.

FIELD OF INVENTION

The invention relates to a hollow-cast casting, which provides at least one core opening that is caused by the production technique and which has a closure device that closes the core opening.

BACKGROUND

The production of high-precision castings requires stable support for casting cores within a casting mold. In the course of the casting operation, the so-called chaplets required for this leave openings in the walls of the casting, which in most applications represent undesired weakening points of the casting, but in particular also undesired leakage points. In this connection, reference should be made in particular to the production of cooled turbine blades, in the interior of which complexly configured air channels are fashioned and these channels have to be formed in a gastight manner in the turbine blade to avoid undesired coolant losses. To produce the internal structure of such blades, casting cores have to be fixed in a very precise and stable manner in the casting mold, fixing the casting cores, which are oriented essentially in the longitudinal direction of the blade, on two sides, i.e. on the side of the blade root and on the side of the blade head, by means of chaplets of relatively large dimensions, which in turn result in large core openings in the casting once casting has been completed, but these are not all desired for proper functioning of the casting. For example, in the case of a cooled gas turbine blade, openings of relatively large dimensions are desired at the blade root in order to feed cooling air into the interior of the blade or remove it again, but particularly openings at the blade head or end of the airfoil of the blade represent undesired openings through which harmful cooling air leakages occur. Subsequent closing of such core openings caused by the casting technique, particularly in the end region of the airfoil of the blade, requires great care and consideration for the operating conditions to which the blade is exposed. For instance, the closure must be made resistant to heating and to temperature changes and stable enough with respect to the centrifugal forces occurring in the case of moving blades.

On the one hand, it would be desirable with respect to production considerations to use chaplets that are as large as possible, which however leads to large core openings also occurring in undesired regions of the casting, but on the other hand there is the need for these very core openings of large dimensions to be reliably closed. The closure mechanisms that have become known in the relevant literature are problematic when used on turbine blades, which undergo high thermal loads: for example, it is proposed in DE 39 36 171 A 1 to close core openings by means of buildup welding. Here, however, there is the latent risk of the placed-on closure piece, which is connected to the casting by a welded connection, becoming detached from the casting and exposing the previously closed opening again. Resultant consequential damage, in particular in connection with moving blades closed in such a way in rotor arrangements of gas turbine installations, is considerable.

In the documents U.S. Pat. No. 2,821,323 and DE 44 34 139 C1, closure plugs driven axially into the core opening are proposed for closing the core openings, but the associated risk of detachment of the corresponding closure plugs caused by centrifugal force, possibly additionally assisted by differential thermal expansions occurring between the closure plug and the casting, cannot be eliminated.

To avoid possible operationally caused detachment of a closure plug referred to above from the core opening of a casting, preferably a rotating gas turbine blade, it is proposed in DE 199 05 887 C1 to introduce a closure piece that closes the core opening in the casting along a clearance which extends transversely in relation to the core opening to be closed within the casting. However, apart from the already existing core opening within the casting, such a measure requires further local removal of material from said casting, causing it to be mechanically weakened further.

SUMMARY

The disclosure is directed to a hollow-cast casting, including at least one core opening and a closure device that closes the at least one core opening. The closure device can be inserted into the core opening axially in relation to the at least one core opening and provides at least one surface region which, in axial projection in relation to the at least one core opening can be made to abut a surface region of the casting that is facing toward the casting. The surface region of the casting lies radially outside a cross-sectional area predetermined by the core opening.

In a second embodiment, the disclosure is directed to a hollow-cast casting, including at least one core opening and a closure device that closes the at least one core opening. The closure device can be inserted into the core opening axially in relation to the core opening and provides at least one surface region which, in axial projection of the core opening, can be made to abut a surface region of the casting that is facing away from the casting. The surface region lies radially outside a cross-sectional area predetermined by the core opening.

BRIEF DESCRIPTION OF THE DRAWINGS

Without restricting the general idea of the invention, the invention is described below by way of example on the basis of exemplary embodiments with reference to the drawing, in which.

DETAILED DESCRIPTION OF THE PREFERRED EMBODIMENTS

Introduction to the Embodiments

Figure 1A:
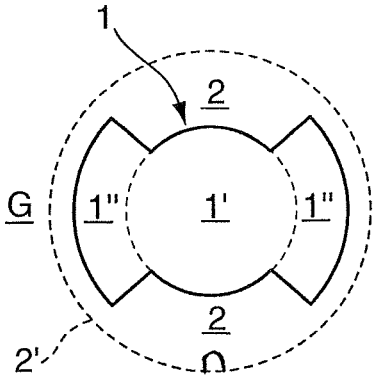
FIGS. 1*a*, 1*b* show a plan view of the opening contour of a core opening and a perspective side view of a closure device.

The invention is based on the object of forming a hollow-cast casting, which provides at least one core opening that is caused by the production technique and which has a closure device that closes the core opening, in such a way that, on the one hand, the risk of operationally caused detachment of the closure device from the casting can be eliminated and, on the other hand, the measures required for this do not in any way allow the casting to be weakened. In particular, the aim is to avoid additional structural weakening within the casting for the purpose of securely anchoring the closing means within the core opening of the casting.

The solution achieving the object on which the invention is based is set forth in the appended independent claims. Features that can advantageously develop the hollow-cast casting formed according to the solution are the subject of the dependent claims and are described in the further description, in particular with reference to the exemplary embodiments.

According to the solution, a hollow-cast casting, which provides at least one core opening that is caused by the production technique and which has a closure device that closes the core opening, is distinguished by the fact that the closure device can be inserted into the core opening axially in relation to the core opening and provides at least one surface region which, in axial projection of the core opening, can be made to abut a surface region of the casting that is facing toward the casting. As this happens, the closure device abuts a surface region of the casting that extends radially outside a cross-sectional area predetermined by the core opening.

The idea on which the invention is based concerns the closure of a core opening caused during production without at the same time weakening the region of the casting around the core opening by additional removal of material, a closure device being inserted axially into the core opening and ensuring that the core opening is closed off in a secure and gas-tight manner by a pressed connection. In a particularly preferred configurational variant of the hollow-cast casting according to the solution, the core opening and the closure device are formed in such a way that the core opening is closed and sealed by way of a bayonet closure.

As an alternative to the closure taking the form of a bayonet closure, a way in which the closure for a core opening can be obtained that is similarly effective and particularly simple is by providing a thread structure surrounding the core opening on the inner wall, with a screw means that can be brought into engagement with said structure, preferably in the form of a grub screw. Like the closure device formed above as a bayonet closure, this may likewise also be secured in the course of an additional material-bonded connection between the closure device and the casting, for example by a welded or brazed connection.

A further preferred configurational variant provides a closure device in the manner of a shaped disk, on one side of which a nozzle-like elevation is provided, the form and size of which are made to match the core opening volume that is radially enclosed by the core opening. The closure device is inserted into the core opening axially from inside, i.e. from the cavity enclosed by the casting, the nozzle-like elevation at least partially filling the core opening and the shaped disk lying against the inner wall of the casting that directly surrounds the core opening radially. There are, in principle, several possibilities for fixing a closure device formed in such a way in the core opening, for example by way of clamping, preferably in the form of a press fit, and/or by a welded or brazed connection. In particular with regard to the closure of core openings in the region of the tip of a moving blade, the centrifugal forces occurring act in a manner additionally assisting intimate closure of the core opening. Detachment of a closure device formed as a projecting shaped disk can be ruled out, with the centrifugal forces indeed acting with a closure-inducing effect on the closure device. Further details of a form this may take can also be taken from the description of actual exemplary embodiments.

A further alternative according to the solution for the closure of a core opening caused by the production technique in a hollow-cast casting, in which the core opening preferably has a rectangular opening cross section, provides as the closure element a strip-like means, preferably produced from metallic material, which, while undergoing deformation, can be pressed against an abutting surface adjoining the core opening on the casting in such a way that the core opening is closed off in a largely fluid-tight manner by the closure element, the closure mechanism being based on the intrinsic deformability of the strip-like closure element and the pressing force that can be produced thereby. Further details of this as well as with respect to the idea of the solution outlined above can be taken from an exemplary embodiment illustrated below.

DETAILED DESCRIPTION

FIG. 1*a* shows the plan view of a core opening 1, which is provided on the surface of a casting G. In particular, it should be assumed that the core opening 1 is provided on the surface on the end face of a moving or stationary blade of a rotary turbo-engine. The core opening 1 has in the exemplary embodiment shown a cross-sectional area which is made up of a circular area 1' and in each case two ring sector areas 1" adjoining symmetrically on both sides of the circular area 1'. The core opening 1 shown in FIG. 1*a* may, in principle, be formed flush with the surface of the casting G, or, as in the case according to the representation of the image in FIG. 1*a*, adjoin a so-called joining area 2 that is set back from the surface of the casting, enclosed by a circular peripheral edge 2'. Furthermore, it should be assumed that the surface region adjoining outside the peripheral edge 2' corresponds to the surface of the casting G, whereas the joining region 2 has over a contour step running along the peripheral edge 2' a surface level that is lowered with respect to the surface of the casting G. The core opening 1 extends with a constant cross-sectional area through the wall of the casting surrounding the core opening.

Figure 1B:
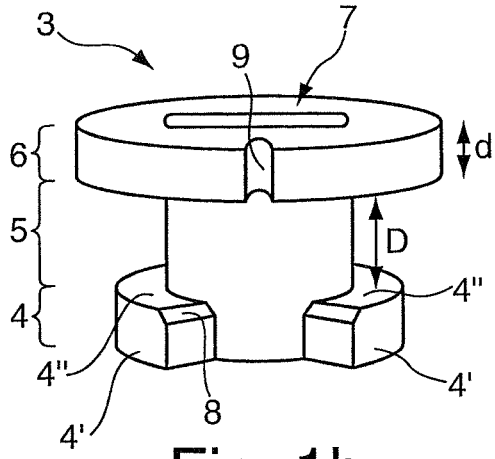

Serving for closing the core opening 1 shown in FIG. 1*a* is the closure device 3 represented in FIG. 1*b*, which is formed in the manner of a bayonet closure and has a base part 4, a middle part 5 and a head part 6. In the exemplary embodiment shown, it should be assumed that the closure device 3 is produced in one piece, though it is also possible to produce the closure device 3 in each case from different materials.

The middle part 5 of the closure device 3 is formed in the manner of a solid or hollow cylinder and, as a consequence, has a circular cross section, which coincides with the circular cross section 1' that can be inscribed in the core opening 1. The base part 4 comprises one or more, for example two collars 4' as illustrated, which are formed in the manner of ring segments and, together with the middle part 5 formed in the manner of a cylinder, produce in axial projection an overall cross section which corresponds to the cross-sectional area of the core opening 1 represented in FIG. 1*a*. Provided at an axial distance from the base part 4 as a result of the middle part 5 is the head part 6, which has a circular cross section which is the same size or smaller than that circular area that is enclosed by the peripheral edge 2'. Additionally incorporated in the head part 6 is a slot-like clearance 7, which is suitable for the engagement of a screwdriver, in order to turn the closure device 3 after insertion within the core opening in a manner correspondingly lower down within the core opening 1. The head part 6 is formed like a circular disk and has a disk thickness d which corresponds to the depth of the step with which the joining area 2 is lowered with respect to the surface of the casting along the peripheral edge 2'. Furthermore, the middle part 5 has an axial extent D, over which the head part 6 is at a distance from the base part 4 and corresponds at least to that material thickness that the casting has as a wall thickness in the region of the core opening 1. Furthermore, it can be seen from FIG. 1*b* that the collar 4' provides a beveled flank 8, which makes it possible for the collar 4' in the interior of the casting to engage more easily under the joining areas 2 by corresponding turning of the closure device 3. In the representation of the image according to FIG. 1*b*, both collars 4' have a corresponding beveled flank on at least one radially extending collar edge.

For closing the core opening 1 represented in FIG. 1*a*, the closure device 3 shown in FIG. 1*b* is inserted axially from above into the core opening, so that the surface of the head part 6 finishes flush with the surface of the casting G. Furthermore, the closure device 3 is turned with a suitable screwdriver through 90°, so that the collars 4' of the base part 4 get under the joining areas 2 represented in FIG. 1*a* and consequently form a bayonet-like closure. By an additional material bond, for example by way of a brazing or welding operation, it is possible to secure the closure device 3 against uncontrolled turning within the core opening 1. Brazing may be advantageously performed between the joining area 2 and the collars 4', the head part 6 and the middle part 5, as an option also between the peripheral edge 2' and the peripheral edge of the head part 6. As a further option, a pin-like securing element 23*a* additionally secures the closure device 3 mechanically against turning within the core opening 1. For this purpose, the head part 6 and the joining area 2 each have at the peripheral edge around the periphery at least one notch-like clearance 9, which after turning of the closure device 3 lie one over the other and into which the securing element 23*a* can be inserted.

The closure mechanism according to the solution is consequently based on an intimate form or force fit between the axially upwardly oriented surface areas 4" of the collars 4', which are made to abut the surface regions of the joining areas 2 that are directed axially toward the casting. It is consequently impossible for the closure device 3 to be able to become detached from the core opening 1 even when centrifugal forces occur.

Figure 2A:
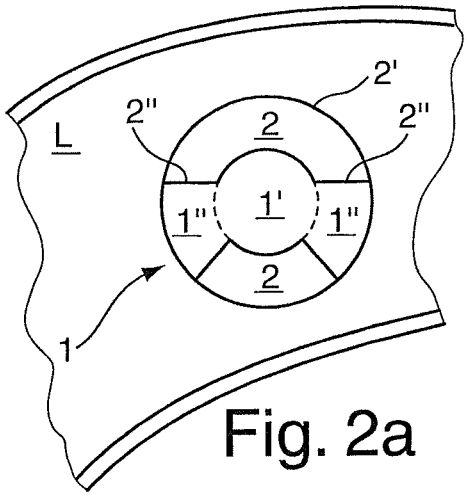
FIGS. 2*a*, 2*b*, 2*c*, 2*d* show a plan view of the opening contour of a core opening and a multi-sided representation through an alternative closure device.
Figure 2B:
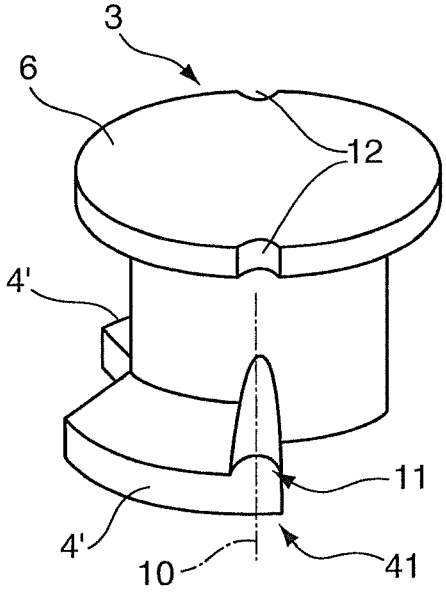
Figure 2C:
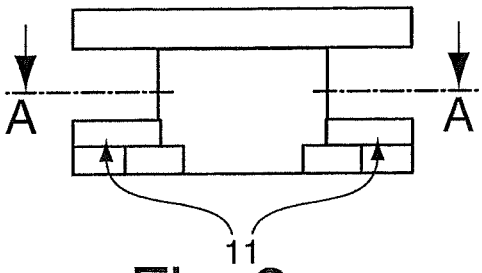
Figure 2D:
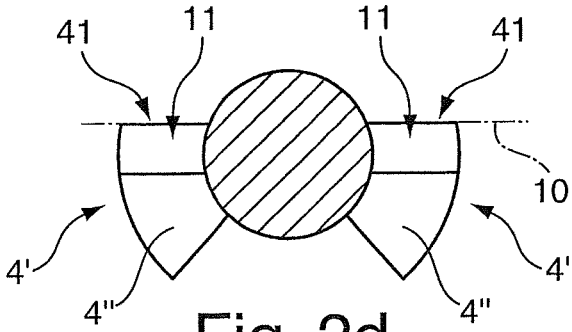

FIG. 2*a* shows the plan view of an alternative form for a core opening 1 which, as in the case of the example according to FIG. 1*a*, is provided at the pointed upper side of gas turbine blading, for example of a moving blade L. Again, the cross-sectional area of the core opening 1 is made up of a circular area 1' and two ring segment areas 1" directly adjoining the circular area 1' laterally. The joining areas 2, which are formed like ring segments and, together with the cross-sectional area of the core opening 1, create in plan view a circular area which is enclosed by the peripheral edge 2', are as it were lowered with respect to the surface of the moving blade L in the exemplary embodiment according to FIG. 1. Provided for closing the core opening 1 represented in FIG. 2*a* is a closure device 3, which is represented in a perspective representation in FIG. 2*b*. A longitudinal sectional representation is shown in FIG. 2*c* and a sectional drawing is shown in FIG. 2*d*, along the section AA indicated in FIG. 2*c*.

The closure device 3 has two collars 4', which are formed like ring segments and, as a difference from the exemplary embodiment according to FIG. 1, have in each case a collar side edge 41, which edges together lie along an axis 10. Furthermore, each collar 4' has a radially extending elevation 11, formed like a rib, along the collar edge 41, which rises up above the surface region 4" of the respective collar 4'. The rib-like elevation 11 serves as a mechanical safeguard against uncontrolled turning of the closure device 3 within the core opening 1 in the following way: the closure device 3 is inserted axially into the core opening 1 and correspondingly in line with the core opening contour until the head part 6 finishes flush with the surface of the moving blade L. Provided in the peripheral edge in the head part 6 are two diametrically opposite clearances 12, in which a corresponding turning tool can be made to engage in order to turn the closure device 3 within the core opening 1 through 180°. As this happens, the rib-like elevations 11 come up against the delimiting edges 2" of the upper joining area 2. During the turning it is necessary that the rib-like elevation 11 of both collars 4' in each case gets under the joining areas 2, as respectively seen in the axial viewing direction; this can be brought about for example by choosing an elastic form and material for the collars 4'. When the closure position is reached, the elevations 11 formed like ribs directly adjoin the side edges 2" of the upper joining area 2 and form a force and form fit therewith, by which the closure device 3 is prevented from turning in an uncontrolled manner out of the closure position.

Figure 3A:
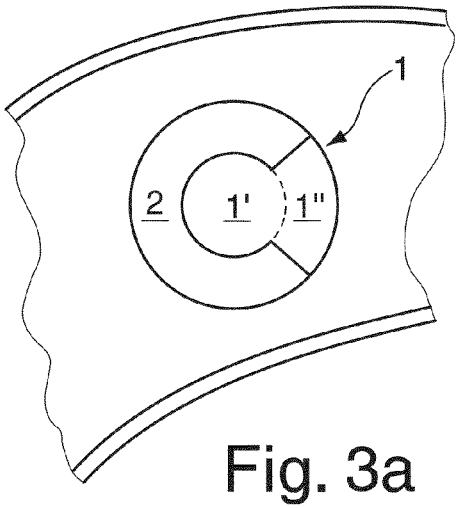
FIGS. 3*a*, 3*b*, 3*c* show a plan view of a core opening and a representation of a closure device that can be divided into two halves.
Figure 3B:
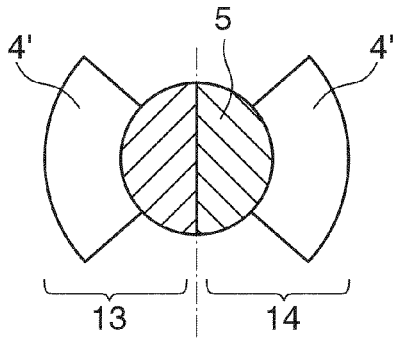
Figure 3C:
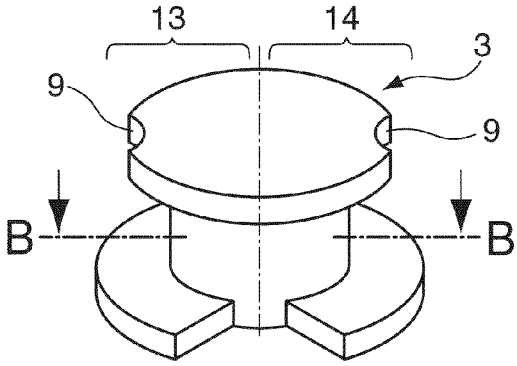

A further embodiment for forming a closure device according to the solution is represented in FIGS. 3*a* to *c*. In principle, the aim is to make the core openings as small as possible, in order to reduce weakening of the casting caused by the openings. The core opening 1 represented in FIG. 3*a* has a smaller cross-sectional area in comparison with the core openings described in FIGS. 1 and 2. Thus, the core opening 1 according to FIG. 3*a* is merely made up of a circular area 1' and a single area 1" formed like a ring segment. To make it possible for a closure device 3 to be axially inserted into the core opening 1 represented in FIG. 3*a*, it is possible to form a closure device in such a way that it only has a single collar 4', as a difference from the exemplary embodiment according to FIG. 1*b*. Such a closure device would be loaded asymmetrically on one side when the collar 4' engages under the joining area 2. It is questionable whether such asymmetry can permanently withstand the loads. Therefore, it is advantageously proposed to form a closure device according to FIGS. 3*b* and 3*c*, which as it were provides the closure device 3 represented in FIG. 1*b* with two symmetrically opposite collars 4'. FIG. 3*b* shows for this purpose a sectional view, taken along sectional l;ine B-B in FIG. 3*c*, through the middle part 5, as seen in the axial viewing direction of the collar 4'. FIG. 3*c* shows a perspective view of the closure device 3. As a difference from the exemplary embodiment according to FIG. 1*b*, the closure device 3 according to FIGS. 3*b* and 3*c* is halved in the middle, so that the closure device 3 can be made up of two symmetrically formed halves 13, 14. For closing the core opening 1 represented in FIG. 3*a*, the two halves 13, 14 are fitted one after the other axially through the corresponding core opening 1 in such a way that first the half 13 is axially inserted and turned through 180°, then the second half 14 is inserted into the remaining core opening 1. Finally, the two halves 13, 14 are then turned through 90°, so that the two collars 4' get under the joining area 2 and produce a symmetrical form fit and force fit with the undersides of the joining area 2.

As a safeguard against turning, the two halves 13, 14 are brazed or welded to the casting, at least at the groove-like clearances 9 provided in the head part 6.

Figure 4B:
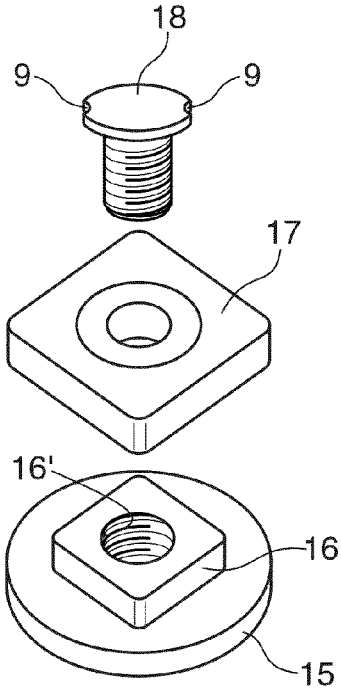
FIGS. 4*a*, 4*b* show a cross-sectional representation and an exploded representation of a closure device comprising a screw, a shim and a nut element.
Figure 4A:
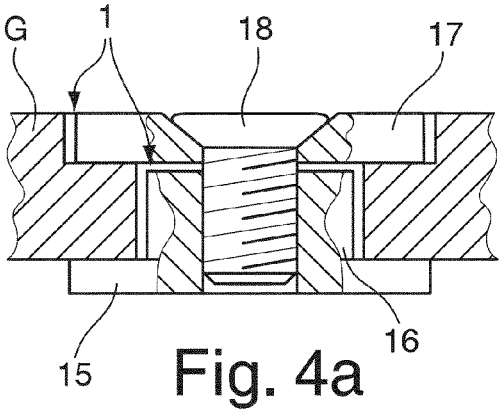

As a difference from the closure device explained above, which are based on the bayonet closure principle, an alternative closure mechanism is explained in FIGS. 4*a* and *b*. FIG. 4*a* shows a cross section through a wall of a casting G in which a core opening 1 has been introduced. For closure of the core opening 1, the closure device, which in FIG. 4*b* is represented in the manner of an exploded representation, provides an element in the manner of a shaped disk 15, on one side of which a nozzle-like elevation 16 is provided, the form and size of which are made to match the core opening volume that is radially enclosed by the core opening 1. For example, it should be assumed that the nozzle-like elevation 16 is formed like a cube and is able to fill the core opening 1 virtually completely (see in this respect the cross-sectional view according to FIG. 4*a*). The fastening of the shaped disk 15 is performed axially from inside the casting G toward the core opening 1, the shaped disk 15 protruding radially beyond the core opening 1 and abutting the inner wall of the casting directly surrounding the core opening 1. In principle it is possible to join the shaped disk 15, formed with the elevation 16, to the core opening 1 by way of a press fit and/or an additional material-bonded connection, for example by means of brazing, welding or adhesive bonding, in order ultimately to seal said opening. In particular in the case of a rotating moving blade, the centrifugal forces occurring are able additionally to drive the shaped disk 15, formed with the nozzle-like elevation 16, into the core opening 1.

The embodiment represented in FIGS. 4*a* and *b*, however, additionally provides a further way of securing the closure by means of a screwed connection. Thus, a shim 17 fills a joining region, formed such that it is set lower down with respect to the surface of the casting G, in such a way that the shim 17 finishes flush with the surface of the casting G. A screw means 18, which is brought into engagement with an internal thread 16' provided within the nozzle-like elevation 16, is able to press the shim 17 axially against the shaped disk 15 inserted into the core opening 1 from within the casting G. As a safeguard against turning, the screw 18 likewise provides in the screw head region groove-like clearances 9, which serve for the introduction of brazing or welding material. Brazing can be performed on the surfaces adjoining one another of the components of the closure device 15, 16, 17, 18 and of the casting G as a result of capillary forces during the liquefying of the brazing material and/or by prior application of brazing material.

Figure 5A:
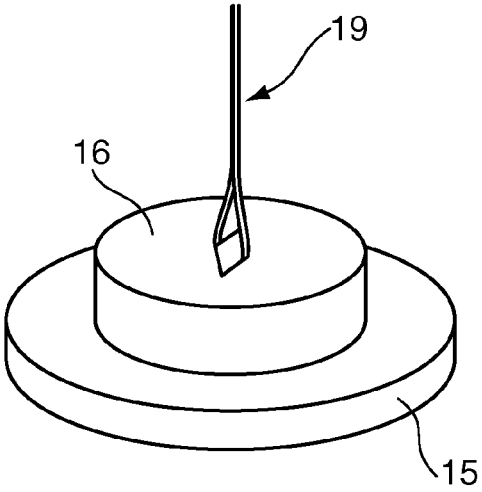
FIGS. 5*a*, 5*b* show a representation of a closure device in the form of a shaped disk with an assembly aid.
Figure 5B:
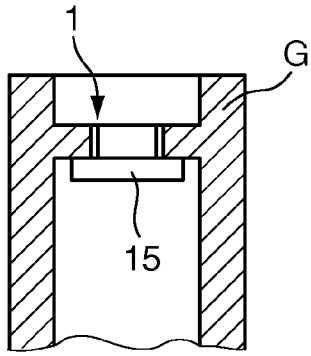

FIG. 5*a* shows a shaped disk 15, which as it were provides the shaped disk 15 represented in FIG. 4 with a collar-like elevation 16, but the shaped disk 15 in FIG. 5*a* is not provided with an internal thread. Rather, a wire-like assembly aid 19 is provided on the nozzle-like elevation, making it possible to fit the shaped disk 15, with the nozzle-like elevation 16 attached thereto, into the correspondingly provided core opening 1 axially from within the hollow-cast casting G. A corresponding cross-sectional representation is represented in FIG. 5*b*. As already stated above, the joining of the shaped disk 15 to the nozzle-like elevation 16 within the core opening 1 may be performed by way of a press fit. In addition or as an alternative, welded or brazed connections are additionally possible, in order to ensure an intimate hold between the shaped disk 15 and the nozzle-like elevation 16 within the core opening 1.

Figure 6A:
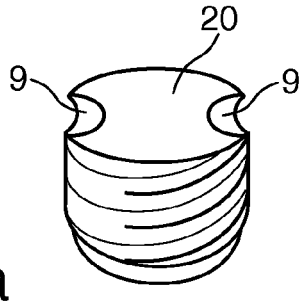
FIGS. 6*a-c* show various views of a closure device in the manner of a grub screw.
Figure 6B:
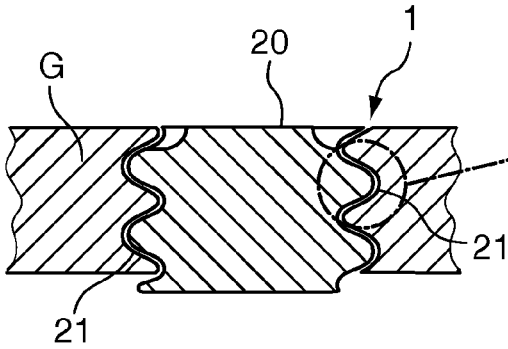
Figure 6C:
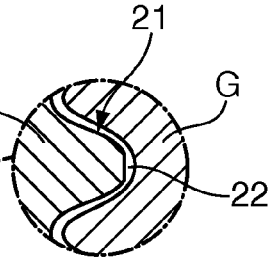

FIG. 6*a* shows a closure device formed as a grub screw 20, which for the closure of a core opening 1 is inserted into an internal thread 21, as shown in FIG. 6*b*, which is provided on the inner contour of the core opening 1. It is particularly preferred here to make the dimensioning of the thread of the grub screw 20 in relation to the internal thread 21 such that between the two thread contours there forms an intermediate gap 22 (see detailed representation in FIG. 6*c*), into which brazing or welding material can flow as far as possible over a large surface area, in order to provide secure protection against turning for the grub screw 20. For this, the grub screw 20 provides corresponding clearances 9 for filling with the brazing or welding material, in which a turning tool can also be made to engage for assembly.

Figure 7A:
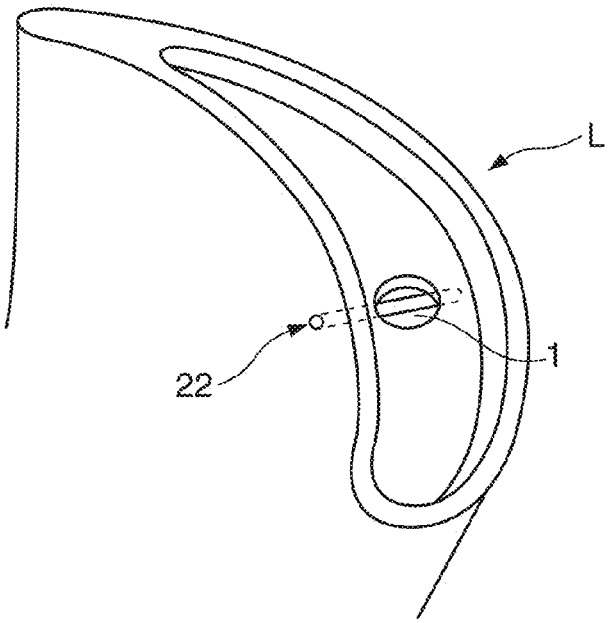
FIGS. 7*a*, 7*b* show a representation of a securing pin.
Figure 7B:
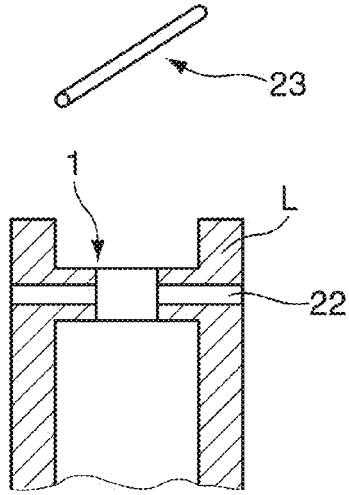

FIGS. 7*a* and *b* show a further measure for securing against uncontrolled turning of a closure device 3 introduced into a core opening 1. Thus it should be assumed in FIG. 7*a* that the casting G is formed in the manner of a stationary or moving blade L, which provides a core opening 1 on the end face. Provided in the region of the core opening 1 is a channel-like clearance 22 through the stationary or moving blade L, which runs transversely in relation to the axial extent of the core opening 1 and reaches through the core opening 1. To secure a closure device introduced into the core opening 1, a securing element 23 formed like a pin is provided and can be inserted along the channel opening 22. For this purpose, it is also necessary to provide the closure device with a suitable clearance, which makes it possible for the securing element 23 to be led through. FIG. 7*b* shows a corresponding cross-sectional representation, on the basis of which the through-opening 22 in the region of the core opening 1 is once again illustrated.

Figure 8A:
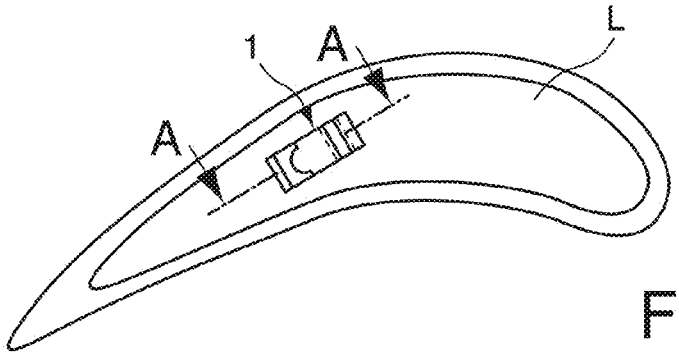
FIGS. 8*a*, 8*b* show a plan view and a cross-sectional representation of a closure device formed as a strip.
Figure 8B:
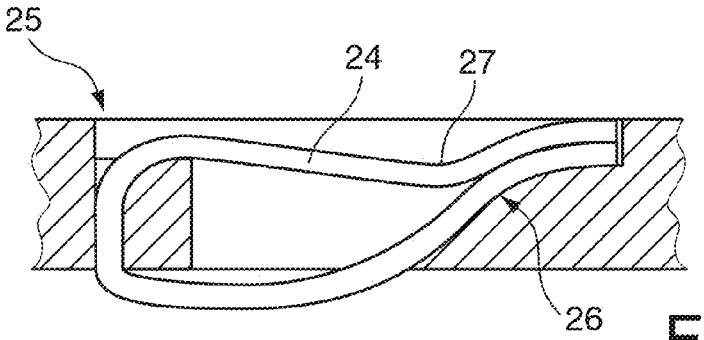

FIG. 8 shows a further closure device 3, which, as a difference from the closure device explained above, is formed like a strip, preferably in the manner of a metal strip or small metal plate. FIG. 8*a* shows the plan view of blading L of a rotary turbo-engine, in which a rectangular core opening 1 has been introduced. For closure of the core opening 1, a metal strip 24 is used as closure device and is threaded into the core opening 1 in the way represented in FIG. 8*b*. The core opening 1 has for this purpose a clearance 25, which is adapted in the form of a slot to the width of the metal strip 4 and through which the metal strip 24 can be axially threaded. Moreover, the core opening 1 is provided with an abutting area 26, to which the metal strip 24 is joined with the same contour. The metal strip 24 has a metal strip length with which the strip-like closure device 24 can be inserted with an exact fit into the form and clearance of the core opening 1 that are shown in FIG. 8*b*. By corresponding deformation, in particular of the upper layer of the strip-like means 24 in the region 27, it is ensured that the strip-like closure device closes off the core opening 1 with a force fit and, in the region of the abutting area 26, with double-layer closely abutting contact. Once again, brazing or welding serves for additional securement.

LIST OF DESIGNATIONS

1 core opening
1' circular area portion
1" circular segment portion
2 joining area, joining region
2' peripheral edge
2" edge of joining area
3 closure device
4 base part
4' collar
4" surface region
41 collar side edge
5 middle part

6 head part
7 slot-like clearance
8 beveled area part
9 groove-like clearance
10 axis
11 rib-like elevation
12 groove-like clearance
13,14 half portions
15 shaped disk
16 nozzle-like elevation
16' internal thread
17 shim
18 screw, fastener
19 wire-like assembly aid
20 grub screw
21 internal thread
22 channel-like clearance
23 pin-like securing element
24 strip-like closure device
25 slot-like clearance
26 abutting area
27 deformation region

What is claimed is:

1. A hollow-cast casting, comprising a joining area, at least one core opening and a closure device that closes the at least one core opening, the closure device can be inserted into the core opening axially in relation to the at least one core opening and provides at least one surface region which, in axial projection in relation to the at least one core opening, can be made to abut a surface region of the casting that is facing toward the casting, the surface region of the casting lies radially outside a cross-sectional area predetermined by the core opening, the closure device having, in axial sequence, a base part, a middle part and a head part, the base part provides the at least one surface region that can be made to abut a surface region of the casting after being made to pass through the at least one core opening, wherein in axial projection, the base part comprises at least one collar having an axial thickness which is formed such that it is beveled on at least one radially extending collar edge, the middle part is formed like a web and connects the base part to the head part, and the head part is formed as a cover element rising up radially around the at least one core opening, the base part and the middle part have a common cross section, adapted to the cross-sectional area of the at least one core opening, wherein the head part has at least one notch-like clearance at a peripheral edge thereof, and the joining area has at least one notch-like clearance for purposes of material-bonded connection.

2. The hollow-cast casting as claimed in claim 1, wherein the closure device enters into at least a force-fitting and/or form-fitting connection with the casting in the region of the at least one surface region.

3. The hollow-cast casting as claimed in claim 1, wherein the at least one core opening and the closure device are formed to produce a bayonet closure.

4. The hollow-cast casting as claimed in claim 1, wherein, in axial projection, the at least one collar protrudes radially beyond the cross section of the middle part and having the at least one surface region.

5. The hollow-cast casting as claimed in claim 1, wherein the hollow-cast casting is blading of a stationary or moving blade of a gas or steam turbine installation in a rotary turbo-engine.

6. The hollow-cast casting as claimed in claim 1, wherein the head part and the joining area each have two notch-like clearances arranged on opposite sides of the respective peripheral edges.

7. A hollow-cast casting, comprising a joining area, at least one core opening and a closure device that closes the at least one core opening, the closure device can be inserted into the at least one core opening axially in relation to the at least one core opening and provides at least one surface region which, in axial projection of the at least one core opening, can be made to abut a surface region of the casting that is facing away from the casting, the surface region lies radially outside a cross-sectional area predetermined by the at least one core opening, the closure device having, in axial sequence, a base part, a middle part and a head part, the base part provides the at least one surface region that can be made to abut a surface region of the casting after being made to pass through the at least one core opening, wherein in axial projection, the base part comprises at least one collar having an axial thickness which is formed such that it is beveled on at least one radially extending collar edge, the middle part is formed like a web and connects the base part to the head part, and the head part is formed as a cover element rising up radially around the at least one core opening, the base part and the middle part have a common cross section, adapted to the cross-sectional area of the at least one core opening, wherein the head part has at least one notch-like clearance at a peripheral edge thereof, and the joining area has at least one notch-like clearance for purposes of material-bonded connection.

8. The hollow-cast casting as claimed in claim 7, wherein the closure device enters into at least a force-fitting and/or form-fitting connection with the casting in the region of the at least one surface region.

9. The hollow-cast casting as claimed in claim 7, wherein the hollow-cast casting is blading of a stationary or moving blade of a gas or steam turbine installation in a rotary turbo-engine.

* * * * *